US009945224B2

(12) United States Patent
Proett et al.

(10) Patent No.: US 9,945,224 B2
(45) Date of Patent: Apr. 17, 2018

(54) AUTOMATIC OPTIMIZING METHODS FOR RESERVOIR TESTING

(75) Inventors: Mark Proett, Missouri City, TX (US); Dingding Chen, Plano, TX (US); Abdolhamid Hadibeik, Austin, TX (US); Sami Abbas Eyuboglu, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 905 days.

(21) Appl. No.: 13/876,113

(22) PCT Filed: Jul. 24, 2012

(86) PCT No.: PCT/US2012/048010

§ 371 (c)(1),
(2), (4) Date: May 13, 2014

(87) PCT Pub. No.: WO2013/016359

PCT Pub. Date: Jan. 31, 2013

(65) Prior Publication Data

US 2015/0040657 A1 Feb. 12, 2015

Related U.S. Application Data

(60) Provisional application No. 61/511,441, filed on Jul. 25, 2011.

(51) Int. Cl.
*E21B 47/06* (2012.01)
*E21B 49/08* (2006.01)

(52) U.S. Cl.
CPC ..... *E21B 47/06* (2013.01); *E21B 49/087* (2013.01)

(58) Field of Classification Search
CPC ..... E21B 47/06; E21B 49/087
See application file for complete search history.

(56) References Cited

U.S. PATENT DOCUMENTS 5,644,076 A * 7/1997 Proett ..... E21B 49/10 166/100
6,012,015 A * 1/2000 Tubel ..... E21B 41/0035 702/6
6,236,894 B1 * 5/2001 Stoisits ..... G05B 13/0265 166/52
2004/0045706 A1 * 3/2004 Pop ..... E21B 47/10 166/250.07

(Continued)

OTHER PUBLICATIONS

International Preliminary Report on Patentability issued in related International Application No. PCT/US2012/048010, dated Feb. 6, 2014, 7 pages.

(Continued)

*Primary Examiner* — Kamini S Shah
*Assistant Examiner* — Steven W Crabb
(74) *Attorney, Agent, or Firm* — John W. Wustenberg; Baker Botts L.L.P.

(57) ABSTRACT

A method of determining a reservoir parameter of a subterranean formation comprising: initiating an initial pressure pulse in the subterranean formation; initiating a series of subsequent pressure pulses in the subterranean formation until the reservoir parameter may be determined, wherein each subsequent pressure pulse is optimized utilizing analytical and/or numerical simulation models; and determining the reservoir parameter.

18 Claims, 10 Drawing Sheets

(56) References Cited

U.S. PATENT DOCUMENTS

| | | | | |
|---|---|---|---|---|
| 2004/0231841 | A1 | 11/2004 | Niemeyer | |
| 2004/0231842 | A1* | 11/2004 | Shammai | E21B 49/008 166/264 |
| 2006/0016594 | A1* | 1/2006 | Krueger | E21B 49/008 166/250.07 |
| 2009/0165548 | A1* | 7/2009 | Pop | E21B 49/008 73/152.51 |
| 2009/0276156 | A1* | 11/2009 | Kragas | E21B 43/12 702/6 |
| 2013/0019672 | A1* | 1/2013 | Hemsing | E21B 49/008 73/152.51 |

OTHER PUBLICATIONS

Lee J., et al., "Enhanced Wireline Formation Tests in Low Permeability Formations: Quality Control Through Formation Rate Analysis," Society of Petroleum Engineers, SPE, No. SPE60293, Mar. 12, 2000, 7 pages.

Meister, M., et al., "Formation Pressure Testing During Drilling: Challenges and Benefits," Society of Petroleum Engineers, SPE, No. SPE84088, Oct. 5, 2003, 8 pages.

Meister, M., et al., "Pressure Gradient Testing With a New Formation Pressure Testing During Drilling Tool," Society of Petroleum Engineers, SPE, No. SPE90425, Sep. 26, 2004, 10 pages.

International Search Report and Written Opinion, PCT/US2012/048010, dated Feb. 11, 2013, 12 pages.

International Search Report and Opinion, EP12177806.2, dated Feb. 11, 2012, 7 pages.

* cited by examiner

AUTOMATIC OPTIMIZING METHODS FOR RESERVOIR TESTING

CROSS REFERENCE TO RELATED APPLICATIONS

This application is a U.S. National Stage Application of International Application No. PCT/US2012/048010 filed Jul. 24, 2012, which designates the United States, and claims the benefit of U.S. Provisional Application No. 61/511,441, which was filed Jul. 25, 2011, and the contents of which are hereby incorporated by reference in their entirety.

BACKGROUND

The present disclosure relates generally to testing and evaluation of subterranean formations, and, more particularly, to methods and apparatuses for testing and evaluating subterranean formations using pressure pulses.

Formation pressure is fundamental in assessing the hydrocarbon yield of a reservoir. Without an estimate of the formation pressure, there is a great deal of uncertainty in a fields' development and the investment required. Virtually all the methods used to calculate the net amount of recoverable hydrocarbon are highly dependent on the initial formation pressure. Field-develop optimization also depends on formation-pressure estimates to verify reservoir depletion and delineate the producing intervals' connectivity.

There have been attempts to find the fundamental properties of tight sand, shale gas, and heavy-oil reservoirs. However, studies on the pressure-transient analysis methods applied to packer and probe-type formation testing have rarely been reported. When a typical draw-down and build-up test is applied, the pressure transient takes too much build-up time to resolve using conventional analysis or a history match to be of practical value in these very low-mobility reservoirs.

Another complication for testing in tight formations is that the measure pressure is supercharged and is greater than the reservoir pressure. The measured shut-in pressure is usually assumed to be the formation pressure. In a permeable formation, mudcake can form quickly and is normally very effective in slowing down invasion and maintaining the wellbore sandface pressure to near that of the formation pressure. However, in low mobility formations, in which there could be no sealing mudcake to isolate the reservoir from hydrostatic pressure, this assumption is unrealistic. In tight formations, the invasion rate is slowed by the formation, and mudcake may form slowly or it may not exist. Therefore, the measured pressure in these cases is substantially greater than the formation pressure as a result of the lack of sealing mudcake.

BRIEF DESCRIPTION OF THE DRAWINGS

A more complete understanding of the present embodiments and advantages thereof may be acquired by referring to the following description taken in conjunction with the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to testing and evaluation of subterranean formations, and, more particularly, to methods and apparatuses for testing and evaluating subterranean formations using pressure pulses.

One purpose of the present disclosure is to provide methods and systems applied to formation testing to reduce testing time. In certain embodiments, the methods discussed herein may be especially suitable in very low mobility formations, such as subterranean formations with heavy oils or low permeability reservoir rocks. In certain embodiments, these methods may be applied to production and drill stem testing (DST) as well as using downhole tools such as the RDT and GeoTap testing tools. The methods discussed herein may also be applied to laboratory testing of rock cores.

Illustrative embodiments of the present invention are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

Figure 1:
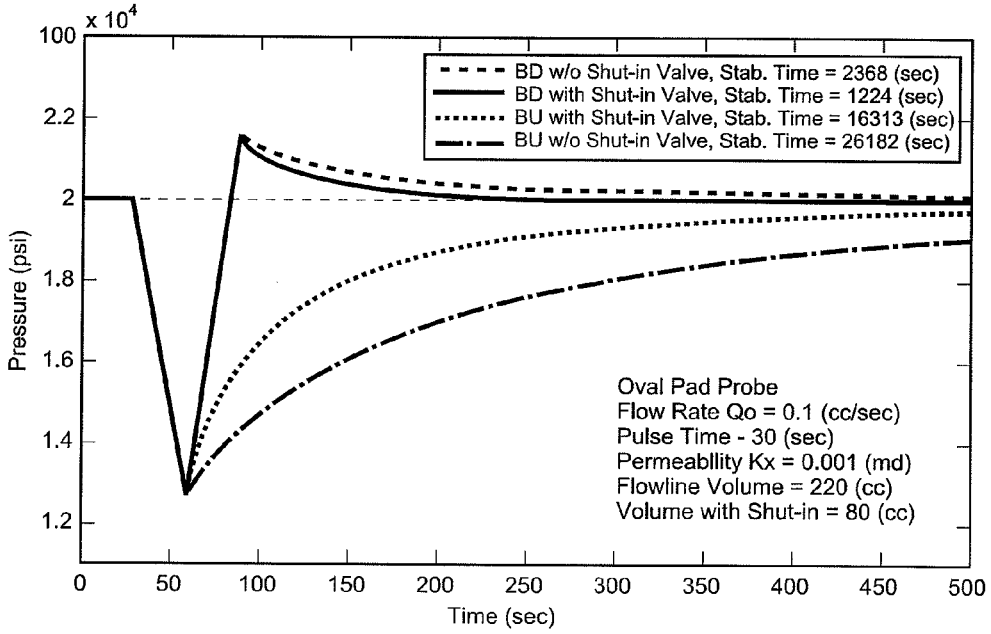
FIG. 1 is a chart depicting the amount of time required to reach a stabilized pressure in certain simulations.

The operational cost of pressure testing using conventional DST methods or downhole tool like the reservoir description tool (RDT) may increase significantly for tight formations due to highly extended pressure stabilization time. Simulations illustrated in FIG. 1 demonstrate that when a conventional drawdown is followed by a buildup, it may take several hours to several days to reach a stabilized pressure, depending on borehole and reservoir conditions, tool configurations, and other operational parameters. To reduce the stabilization time, part of the flow line volume may be isolated with shut-in valves, which may reduce the volume of fluid storage that slows the buildup. FIG. 1 illustrates two different buildup curves, one without a shut-in valve and one with a shut-in valve. As can be seen by FIG. 1, the shut-in valve reduced the flow-line volume from 200 cc to 80 cc and reduced the buildup time from 26,182 sec (7.3 hrs) to 16,313 sec (4.5 hrs) The stabilization may be reached faster by injecting a small amount of fluid into formation after drawdown in a short time interval, and may make the pressure decline or builddown afterward start at a pressure close to formation pressure which converges even faster to formation pressure (i.e., 2,368 sec without Shut-in and 1,224 sec with Shut-in). For the purposes of this disclosure, the process involving fluid drawdown and fluid injection is referred as pulse testing and has certain embodiments have been described previously in U.S. Patent Application Publication No. 2011/0094733.

The simulation illustrated in FIG. 1 is based on the assumption that the pulse starts at reservoir pressure. In practical testing situations, the test may start at either an over balanced (greater than formation pressure) or underbalanced (less than formation pressure) condition. For practical situations, the formation pressure may be unknown and the pressure test may start at the hydrostatic pressure. Once the pulse is applied, the formation may return to hydrostatic pressure or higher and then the builddown may take much longer than if it had started at the formation pressure.

Figure 2:
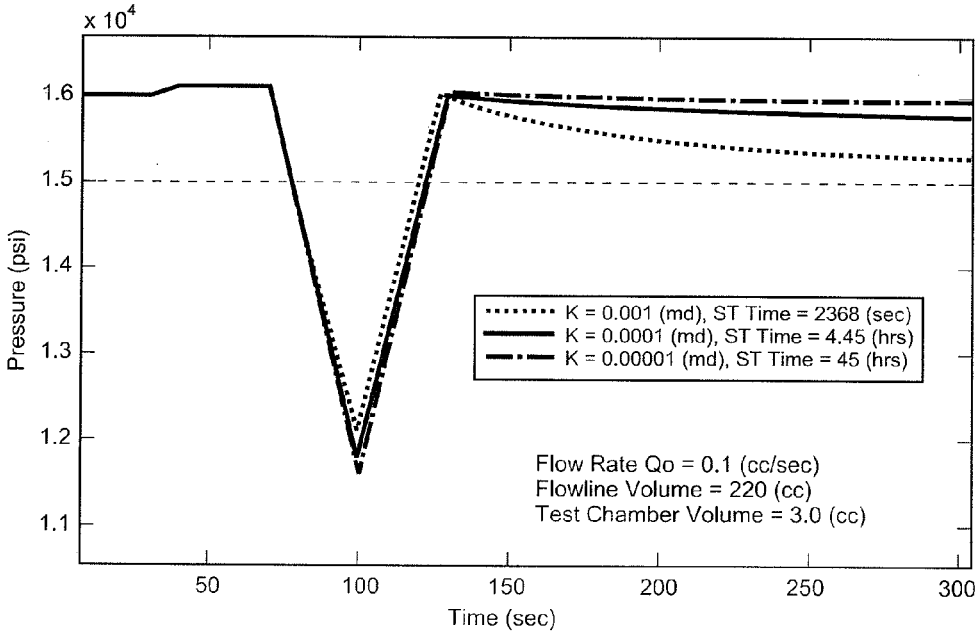
FIG. 2 is a chart depicting transient pressure and stabilization time as a function of a reservoir permeability.

FIG. 2 illustrates an additional testing complication where the builddown may take hours, or even days, for formations with low permeabilities. As shown in FIG. 2, a single pulse (single drawdown followed by a single injection) may work for 0.001 (mD) reservoir, but the stabilization time with same design parameters may be too long for very tight formation (permeability K=0.0001 and 0.00001 (mD)). Furthermore, the builddown pressure may not be the formation pressure because, in the case of open hole testing, the hydrostatic pressure may influence the pressure measured. In an overbalanced condition this is called supercharging, since the measured pressure is above the actual formation pressure. A similar condition exists for underbalanced testing when the measured pressure is influenced by the hydrostatic pressure. These practical considerations may introduce additional parameters and the effectiveness of applying pulse test may rely on the interaction of multiple reservoir parameters (such as formation permeability, fluid mobility, hydrostatic pressure and mud-cake property) and pulse parameters such as drawdown and injection pulse time and flow rate.

Instead of using a single pulse with fixed design parameters, a general solution may be implemented by initiating a pulse sequence where each pulse is optimized in response to matching parameters of the diverse reservoir conditions. The optimization may be designed to determine the reservoir properties including stabilized pressure, actual formation pressure, formation mobility, formation permeability, mud-cake properties and formation damage. In one embodiment, the present disclosure provides a basic method involves initiating a pressure pulse that is followed by a series of pulses that are optimized with analytical and or numerical simulation models to minimize operational time and cost in determining reservoir parameters.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

Figure 3:
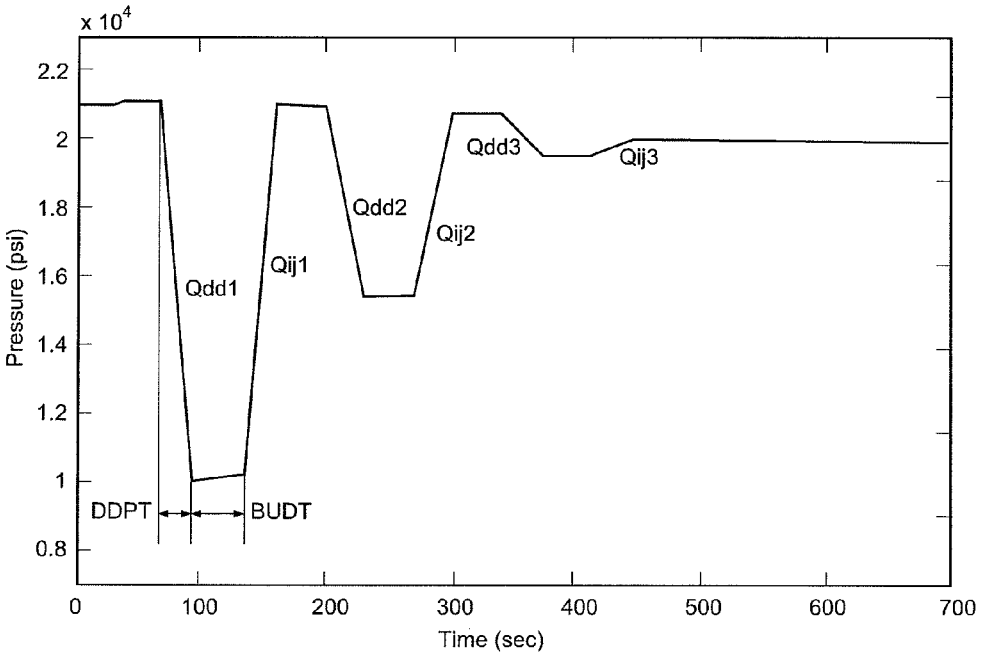
FIG. 3 is a chart depicting a pressure transient profile and design parameters for pulse tests, in accordance with certain embodiments of the present disclosure.

Pulse test design optimization may be an iterative forward modeling process in which borehole conditioning (borehole parameters, supercharge and mud properties), reservoir parameters (formation pressure and permeability, fluid viscosity and compressibility), tool specifications (equivalent probe radius, flow-line and test chamber volume) and flow type (spherical flow or cylindrical/radial flow) are given. FIG. 3 illustrates a typical pressure transient profile and design parameters for pulse test. An example optimization method and procedure is summarized below.

A pulse test sequence may include a series of either drawdowns or injections where each is followed by a stabilization period. The first drawdown or injection pulse may be determined by the expected formation conditions. For example, controls such as the starting drawdown or injection rate may be applied and the drawdown or injection may continue until a desired pressure, pressure transient, or volume is obtained. In other embodiments, another form of pulse control may be achieved by varying the rate and volume during the pulse to obtain a desired final pressure. A buildup or builddown time may be inserted between the drawdown and injection pulses. A period where there is no flow is induced, referred to as a stabilization time, may also be introduced. The observed pressure transient during this no flow period may be used to determine the next or optimized pulse control parameters (drawdown or injection). In analytical simulations, the pressure response of a sequential drawdown, buildup, injection and builddown test can be expressed in Eq. (1) to Eq. (4)

$$P_{dd}=P_f-p_s\times f(t_{dd},r_d,c_d,s) \tag{1}$$

$$P_{bu}=P_{dd}+p_s\times f(t_{bu},r_d,c_d,s) \tag{2}$$

$$P_{ij}=P_{bu}+p_s\times f(t_{ij},r_d,c_d,s) \tag{3}$$

$$P_{bd}=P_{ij}-p_s\times f(t_{bd},r_d,c_d,s) \tag{4}$$

where $P_f$, $P_{dd}$, $P_{bu}$, $P_{ij}$, and $P_{bd}$ are initial reservoir pressure, drawdown pressure, injection pressure and builddown pressure respectively, f is dimensionless pressure response of a flow model determined by test duration, source radius, borehole storage coefficient and skin factor. The pressure conversion factor $p_s$ is a function of the induced flow rate, fluid mobility and the equivalent radius of the tool. During pulse test, the measured pressure response at the current time is a superposition of pressure response of the previous pulses.

In general after the first drawdown or injection, the optimized injection or drawdown pulse flow rate and volume may be smaller than or equal to the previous pulse. One method of optimization may comprise having each subsequent pulse move the pressure closer to a stabilized pressure and minimize testing time. The pulse optimization can also include supercharge model and other non-Darcy flow effects such as slippage, transition flow, and diffusion. Once sufficient pulses and no flow periods are obtained to determine the desired formation properties, the test may then be terminated.

Figure 4:
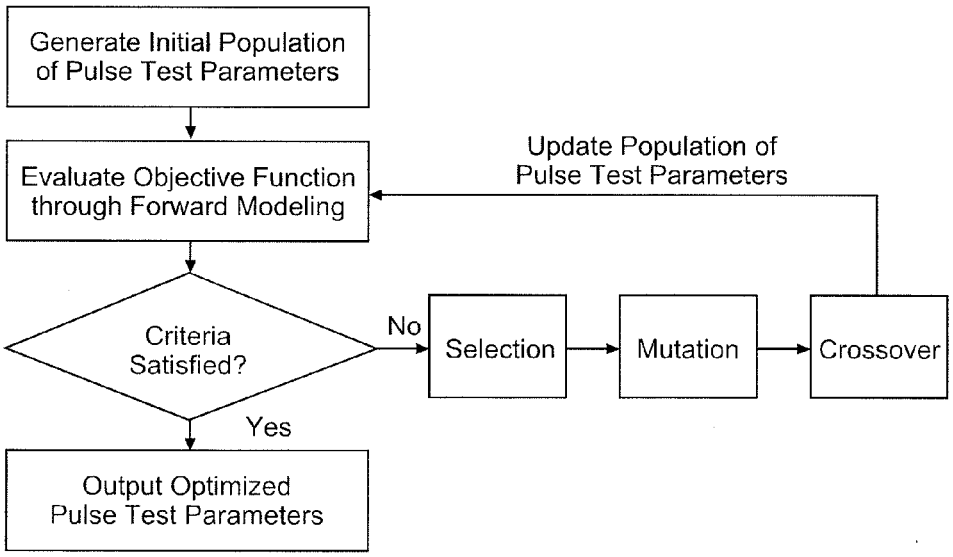
FIG. 4 is a test flow chart of an algorithm for optimizing multiple pulse parameters, in accordance with certain embodiments of the present disclosure.

The following is an example of one method of optimizing the pulse sequence using a genetic algorithm. The first parameter to be optimized may be the drawdown pulse time DDPT, which may range from 10 seconds to 120 seconds. Given the drawdown pulse time, the initial flow rate for the first drawdown and first injection may be selected the same, which is TVOL/DDPT, where TVOL is the volume of test chamber. The second parameter to be optimized may be the buildup down time (BUDT) between each drawdown and injection, which may range from 30 seconds to 120 seconds. The third parameter to be optimized may be the ratio of the second drawdown flow rate over the first injection flow rate (Qdd2/Qij1), which may range from 0.2 to 1.0. The fourth parameter to be optimized may be the ratio of the second injection flow rate over the second drawdown flow rate (Qij2/Qdd2), ranged from 0.2 to 1.0. The fifth parameter to be optimized may be the ratio of the third drawdown flow rate over the second injection flow rate (Qdd3/Qij2), which may range from 0.2 to 1.0. The sixth parameter to be optimized may be the ratio of the third injection flow rate over the third drawdown flow rate (Qij3/Qdd3), which may range from 0.2 to 1.0. A genetic algorithm may be used to evolve the six parameters described above, and an example flow chart for such an algorithm is shown in FIG. 4. This embodiment is best suitable to pre job design with a fixed sequential pulse pattern as shown in FIG. 3.

To optimize pulse test parameters, as illustrated in FIG. 4, a population of initial guesses with different parameter combinations are randomly created first and substituted into a forward flow model individually to calculate pressure response in time series. An objective cost function may be used to evaluate stabilization time after a pre-determined pulse sequence is applied. Then the pulse parameter combinations of the examples are updated based on performance measurement through a number of generations with use of genetic operators, such as ranking, selection, mutation, and crossover to minimize the stabilization time. If the testing performance meets the requirement or other stopping criteria are satisfied, the optimization process can be terminated. In this application, the default population size for evolutionary computation may be set to 30, i.e., 30 different parameter combinations for each generation. The default number of generations may be 20 for a cost-effective solution. The objective function used for pulse test design may be a congregated measure (algebraic sum for example) of stabilization time consisting of three items. The first item may be the relative error in formation pressure at the point after the third injections, the second item may be the relative error in formation pressure at the point 1,000 seconds afterward, and the third item may be the time measured at the completion point of the third injection in hours which may have a similar scale to relative error in formation pressure. Forward analytical modeling integrated with GA optimization is computational efficient, and more parameters may be included in optimization with very limited extra cost in computation time. The ranked multiple solutions may also be used as starting points for more complicated and more accurate numerical simulations. In this case, a primary objective may be to minimize the testing time for a stabilized pressure. However, alternative performance measure may also be introduced to minimize the stabilization time and make pulse parameters more operationally practical.

Figure 5:
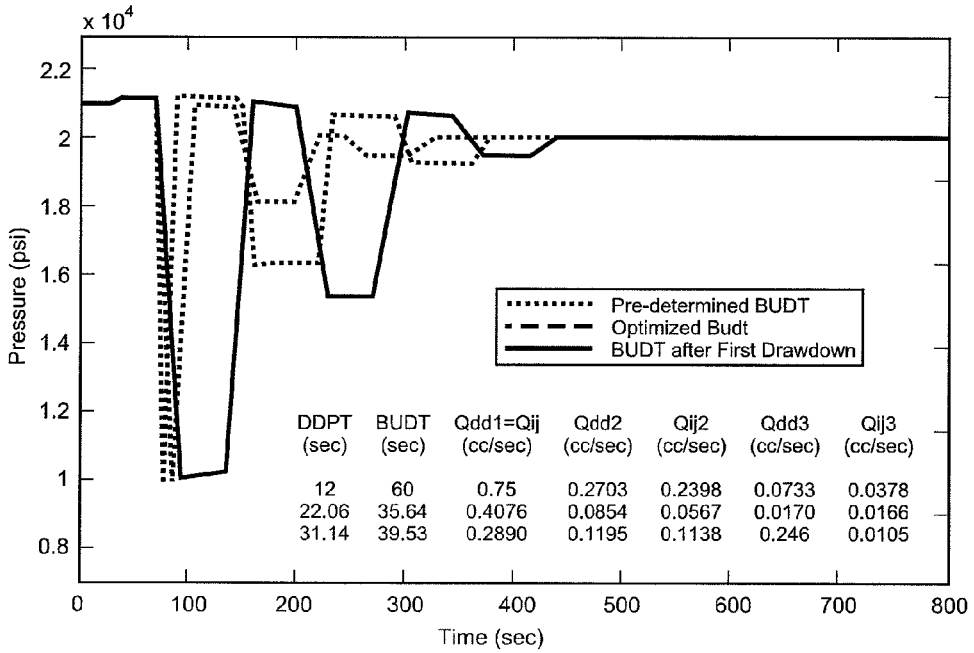
FIG. 5 is a chart depicting a pressure transient profile and design parameters for pulse tests, in accordance with certain embodiments of the present disclosure.

FIG. 5 illustrates transient pressures and optimized pulse parameters under three testing conditions. For each of these three testing conditions, the formation pressure (20,000 psi) and the permeability (0.00001 mD) were the same. For test condition 1, a manually selected BUDT was utilized after the first injection. For test condition 2, an optimized BUDT was utilized. It was assumed that through evolutionary computation, which converged fast to a stabilized pressure, that the stabilized pressure was the formation pressure. For test condition 3, the same profile as shown in FIG. 3 was utilized with BUDT inserted before the first injection. In other two cases, however, injection was followed immediately after the first drawdown. It may be observed from FIG. 5 that optimized pulse parameters may change the values as testing procedure varies. In practice, tool physics and control routine may impose constraints to the actual implementation of the pulse test. The optimization algorithm disclosed herein with GA is capable of providing robust solution based on any user-preferred response pattern.

Figure 6:
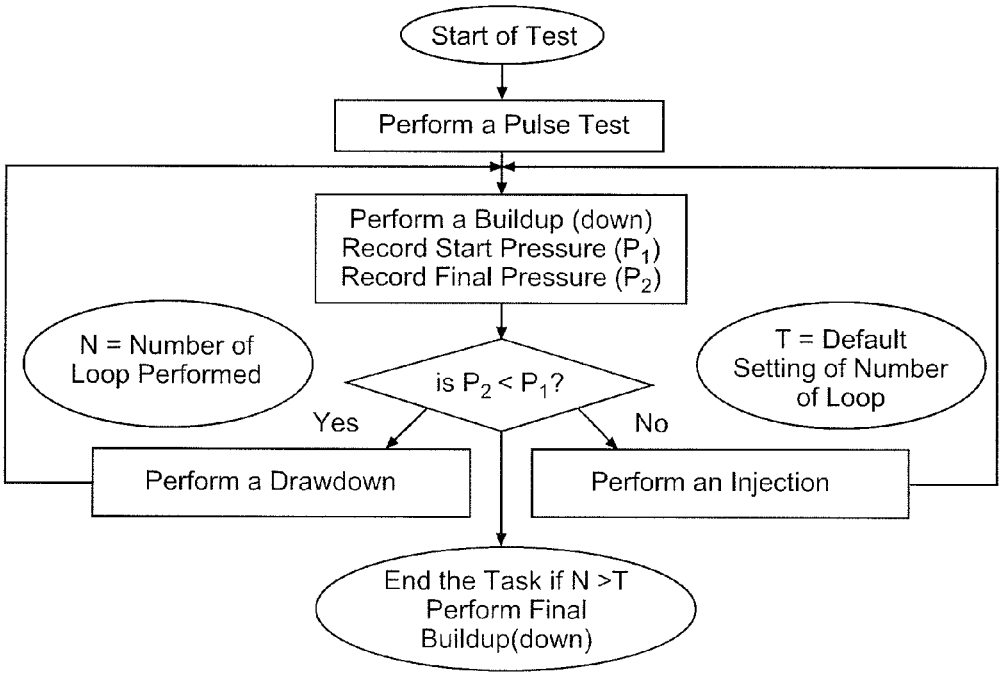
FIG. 6 is an automated pulse test algorithm, in accordance with certain embodiments of the present disclosure.

The pulse design optimization described above may be a simulation based approach using user-specified response patterns. In actual field test, since formation pressure and permeability may be unknown, the simulation based operational parameter optimization may not fully apply. To overcome this limitation, an automated pulse test method, as shown in FIG. 6, for field application may be used. A pulse test, a drawdown followed by an injection test, may be applied to the formation with a packer or a probe-type formation tester. An oval probe, an oval pad, or a standard probe may also be used. Next, the source may be shut-in to record the shut-in pressure during the no flow period. Based on pressure data during the shut-in period, a decision can be made to decide to apply the next drawdown or injection test, the flowrate of which may be a fraction of the initial pulse rate followed by another shut-in test. This fraction may be constant or may be determined by the optimization method. After which, an extended shut-in test may be performed. This procedure may continue until the difference in pressure data at the beginning and the end of shut-in period is reduced to a certain bound, or the number of iterations exceeds a pre-determined threshold.

An overall advantage of this method is to reduce the pressure stabilization time with implementing an adaptive pressure feedback in the system. It has been found that the effect of wellbore storage and fluid compressibility may reduce the pressure drop and overshoot in the drawdown and injection tests respectively. It has also been found that the decay in the asymptote of pressure response may also be affected. Therefore, the combined pulse test method with the pressure feedback system and wellbore storage effect may render the reservoir pressure in the tight formations.

Figure 7:
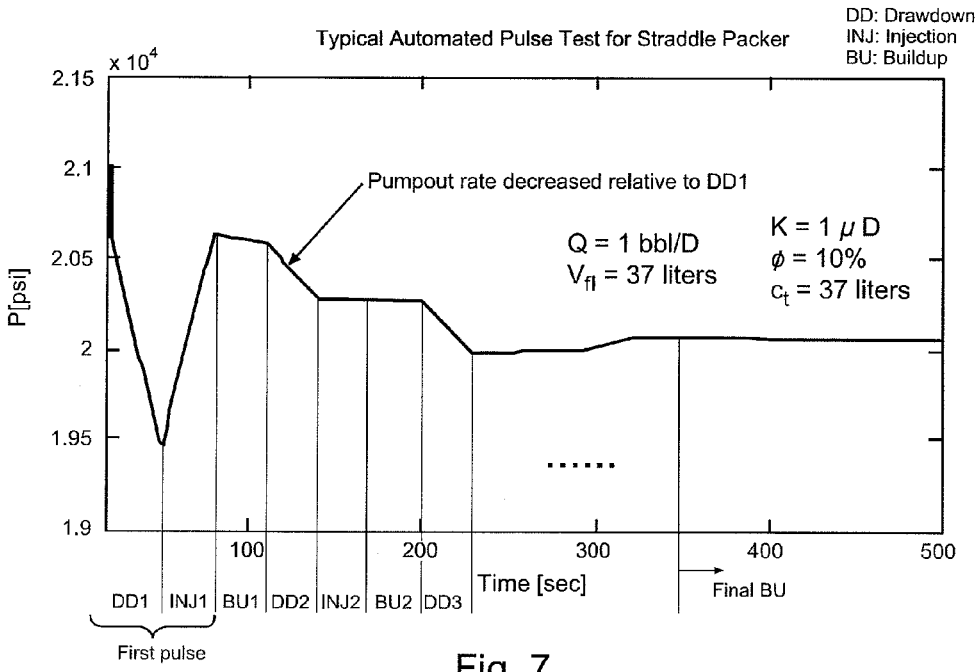
FIG. 7 depicts the results of an automated pulse test, in accordance with certain embodiments of the present disclosure.
Figure 8:
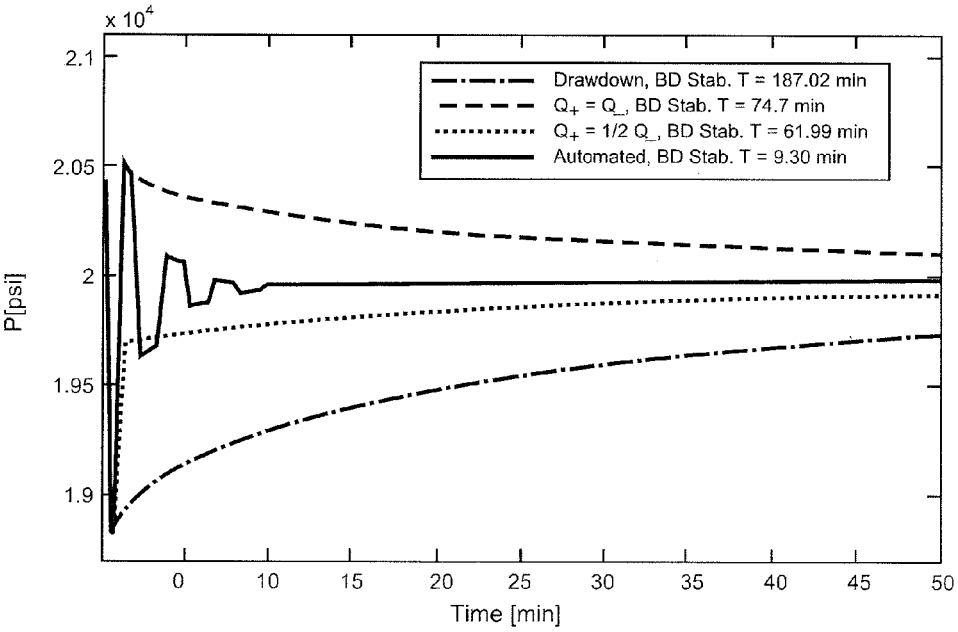
FIG. 8 is a chart comparing the results of pulse testes, in accordance with certain embodiments of the present disclosure.

The automated pulse-test method has successfully been tested considering the effects of wellbore storage and overbalance pressure in tight gas and heavy oil formations invaded with the water- and oil-base mud filtrate invasion. The tested method utilized successive pressure feedbacks and automated pulses to yield a pressure in 0.5% range of the initial reservoir pressure whiling decreasing the wait time by a factor of 10 for a packer type formation tester. FIG. 7 indicates the elements of an automated pulse test technique to reach the stabilization in the reservoir pressure and shows a representative response obtained from performing an automated pulse test. FIG. 8 compares the automated pulse test with other methods. Specifically, FIG. 8 compares the automated pulse test method with a simple drawdown, a one pulse test, and a half pulse test for the oval pad probe. The automated test stabilization time is shown to be 20 times faster than a standard method.

As demonstrated above, automated pulse test may be run in the field with formation pressure and permeability determined at the end of test. Alternatively, derivative plots with a supercharged model and pulse feature matching techniques may be used as alternative approaches. The term "supercharge" is defined when the near-wellbore pressure is different from the initial formation pressure, which is caused by an overbalanced pressure (the mud-filtrate invades the reservoir) or underbalanced drilling condition (the reservoir bleeds into the wellbore). This effect makes the formation pressure near the borehole wall much higher or lower than the far-field pressure in tight formations. The supercharging effect can be measured by adding an observation pressure gauge after setting the packer- or probe-type formation tester.

Figure 9:
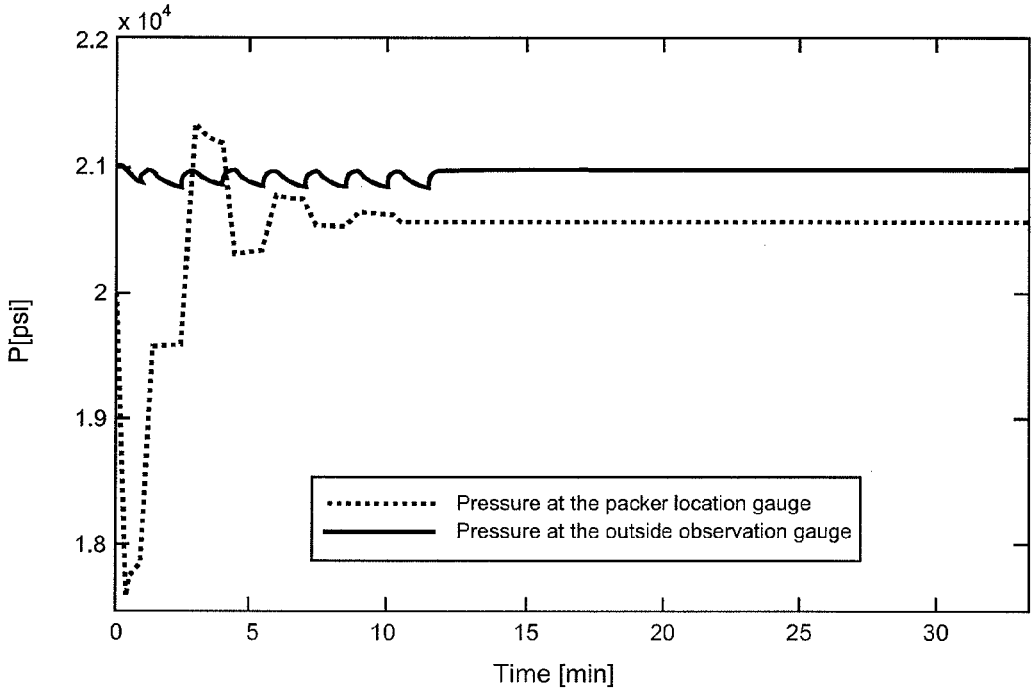
FIG. 9 depicts the results of a pulse test with two observation probes applied to a straddle packer.
Figure 10:
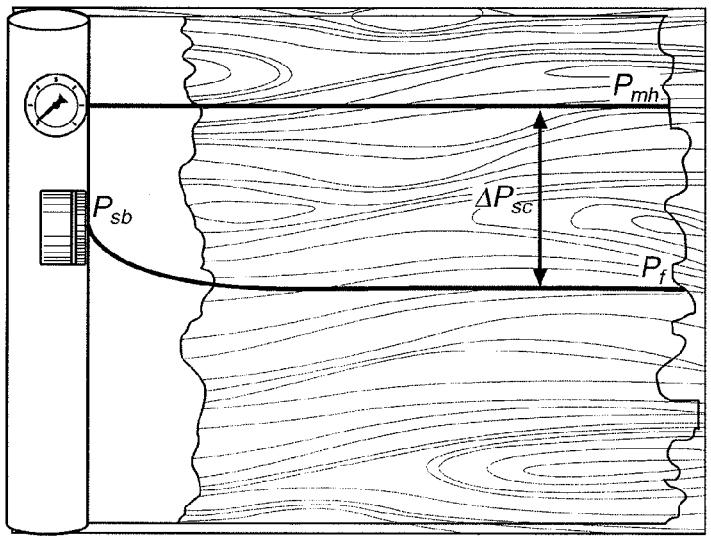
FIG. 10 is an illustration of calculations of supercharge pressure in overbalanced conditions.

FIG. 9 shows the pressure response of a straddle packer with automated pulse test method with one observation gauge located outside the packer wall and the other one at the packer location. The number of observation probes can be increased to yield more information about the properties of the reservoir such as permeability and anisotropy. Due to the superposition principle, the amplitude response of pressure at the outside observation probe in FIG. 9 becomes large as time passes, even though the pulse signal amplitude at the packer location declines with time.

The equations used in derivative analyses are described below. Equation (5) may be used for permeability calculations applied to tight sand using the early build up data $$k_f = \frac{14696}{2\pi}\frac{q_{bu}(t)\mu}{r_p\lambda_\alpha(P_{ibu} - P(t))}, \tag{5}$$

where $q_{bu}(t)$ is the invasion rate during buildup period, $P_{ibu}$ is the initial pressure at the start of buildup period, P(t) is the pressure changing with time, $r_p$ is the probe equivalent radius, and $\lambda_\alpha$ is the shape factor.

Invasion rate during buildup period may be calculated as:

$$q_{bu}(t) = c_{fl}V_{fl}\frac{dp}{dt}. \tag{6}$$

For early time, it can be shown that:

$$\frac{dp}{dt} = \frac{1}{\alpha}(P_{ibu} - P(t)), \tag{7}$$

where $\alpha$ is a constant; knowing the pressure during buildup period, and its derivative, $\alpha$ can be calculated as:

$$\frac{1}{\alpha} = \left.\frac{\frac{dp}{dt}}{(P_{ibu} - P(t))}\right|_t. \tag{8}$$

Formation permeability may be calculated as follows:

$$k_f = \left(\frac{14696}{2\pi}\frac{\mu c_{fl}V_{fl}}{r_p\lambda_\alpha}\right)\frac{1}{\alpha}. \tag{9}$$

The supercharge pressure ($\Delta P_{sc}$) is defined as the difference between sandface pressure ($P_{ss}$) and formation pressure ($P_f$), as shown in equation 10 or 11:

$$\Delta P_{sc} = P_{ss} - P_f = 14696\frac{q_m\mu}{2\pi hk_f}\mathrm{Ln}\left(\frac{r_f}{r_w}\right), \tag{10}$$

or $$\Delta P_{sc} = P_{ss} - P_f = 14696\frac{q_m\mu}{2\pi hk_f}\mathrm{Ln}\left(\frac{4k_f t}{\gamma\phi\mu c r_w^2}\right), \tag{11}$$

in tight sand formation, there may be no mudcake present; therefore sandface pressure ($P_{ss}$) may be the same as mud hydrostatic pressure ($P_{mh}$); $q_m$ is the filtrate loss.

The velocity of the fluid near the wellbore may be defined as:

$$S_m = \frac{q_m}{2\pi hr_w}, \tag{12}$$

it also can be written as:

$$S_m = \frac{k_f}{\lambda_e r_e \mu}\left(\frac{P_{ss} - P_{sb}}{14696}\right), \tag{13}$$

which is the disturbance caused by the pad element blocking the seepage of the mud around the source; $\lambda_e$ is the element shape factor, and $r_e$ is the local geometric correction for non-spherical effects.

Combing equations 11 and 13, the formation pressure ($P_f$) may be:

$$P_f = P_{mh} - (P_{mh} - P_{sb})\frac{r_w}{\lambda_e r_e}\mathrm{Ln}\left(\frac{4k_f t}{\gamma\phi\mu c r_w^2}\right), \tag{14}$$

where $P_{sb}$ is the final stabilized pressure at the end of build up test. The faster this stabilization to happen, the faster and more accurate the formation pressure can be retrieved. The automated pulse test helps to achieve $P_{sb}$ faster than conventional methods.

Figure 11:
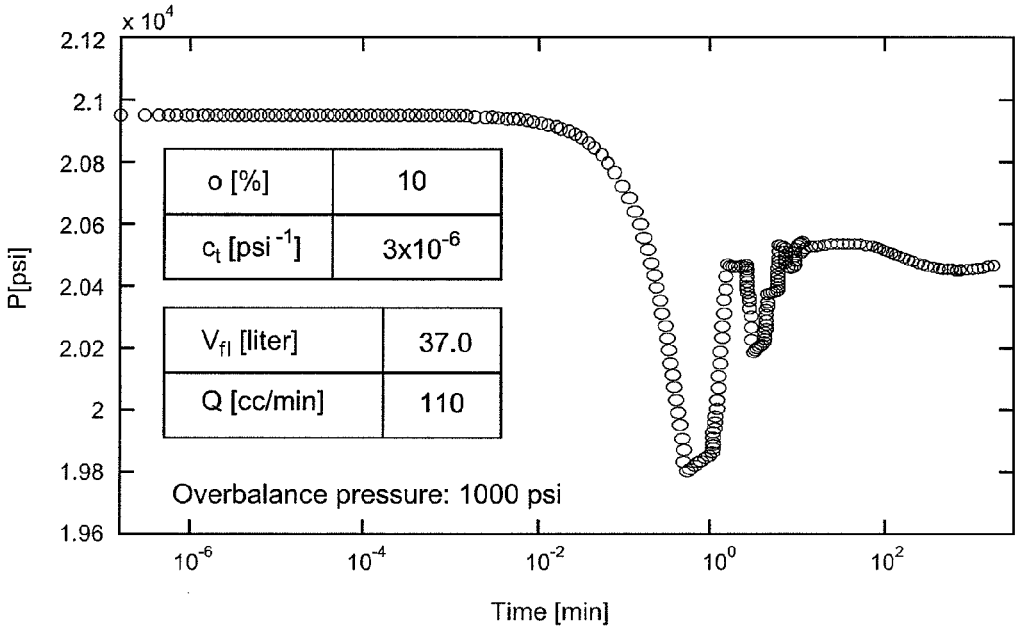
FIGS. 11-14 depict the derivative analysis on the results of automated pulse tests, in accordance with certain embodiments of the present disclosure.
Figure 12:
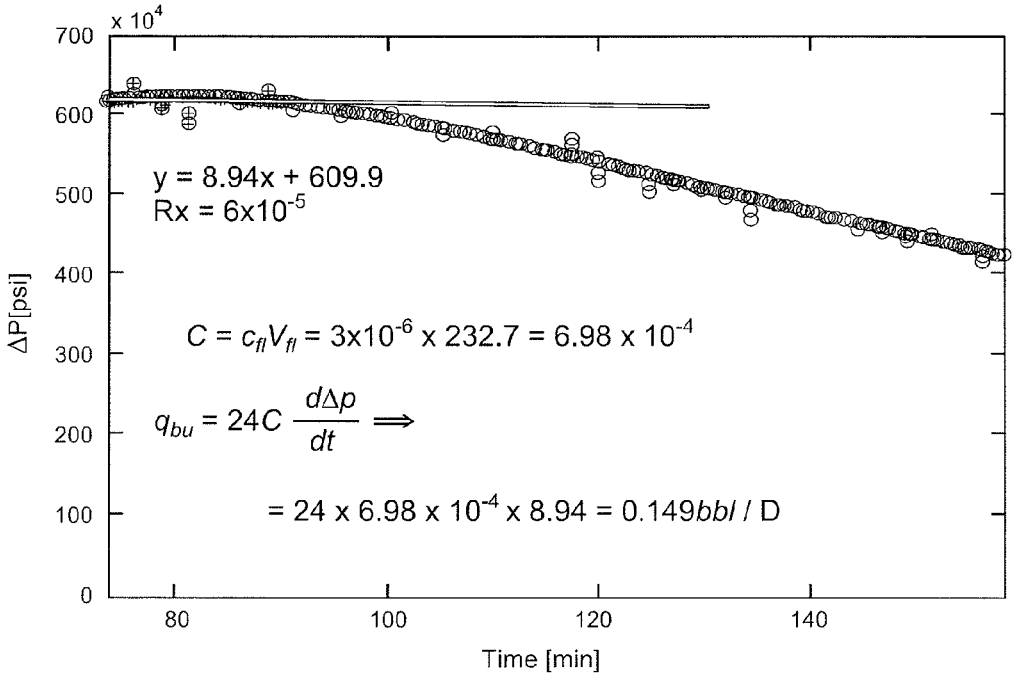
Figure 13:
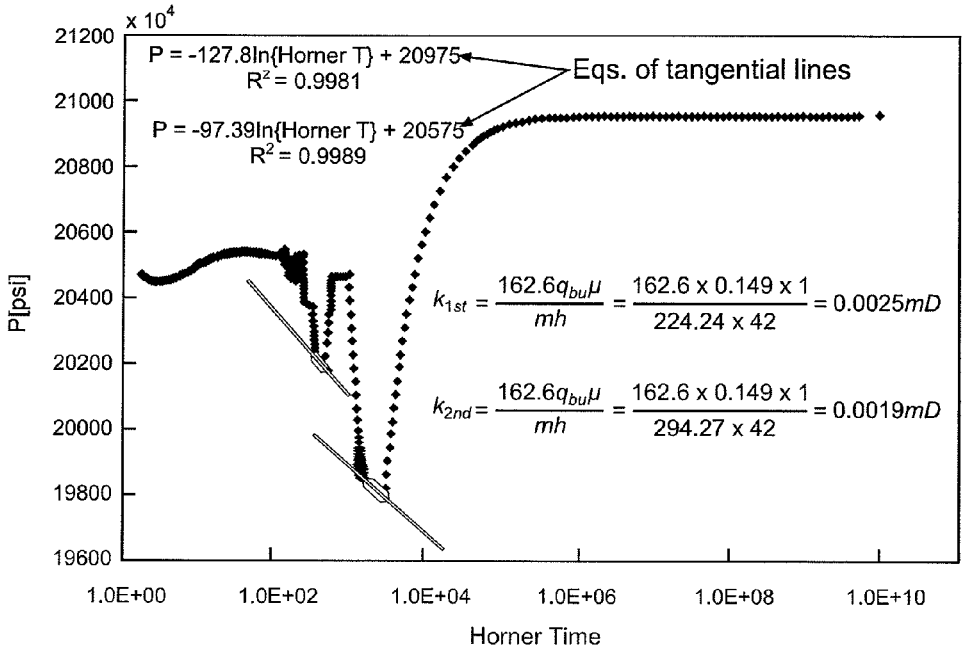
Figure 14:
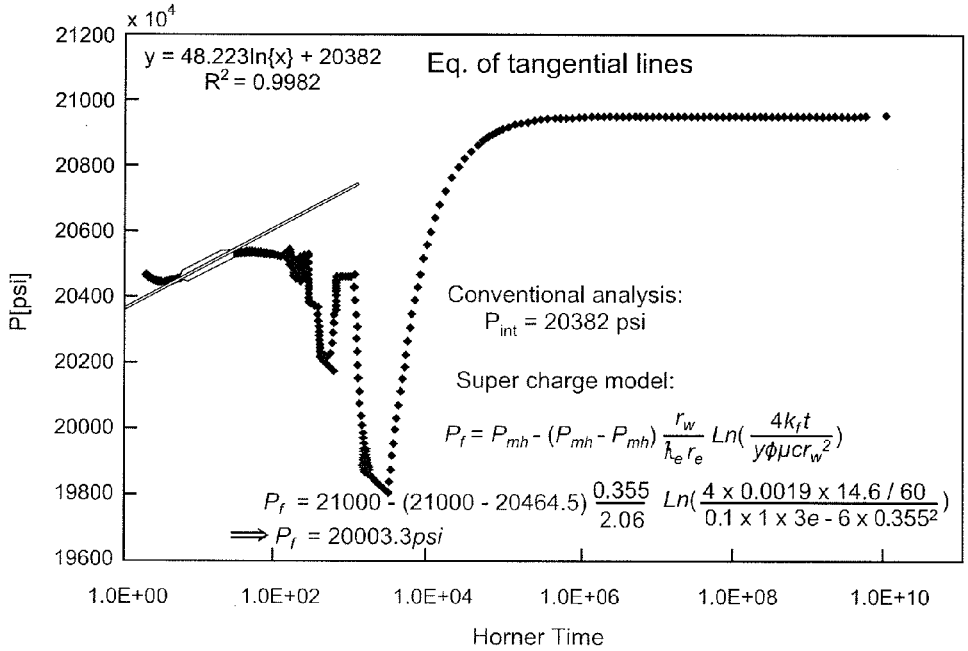

FIG. 11 presents the semi-log data of automated pulse test in a synthetic formation with a packer-type formation tester under the supercharge effect. The pulse test data can also be plotted in Horner time or other time scales as a standard practice. FIGS. 12 through 14 illustrate the derivative analysis in conjunction with the supercharge model to estimate true reservoir pressure and permeability. FIG. 12 shows the change of pressure response during the final shut-in test. The rate of mud-filtrate invasion may be calculated from Equation (6) with pressure derivative obtained from the line which is tangential to the early transient data. In reality, any intermediate buildup (down) data can be used to estimate the reservoir permeability from the slope of its tangential line. In FIG. 13, two different shut-in period data are analyzed, and the permeability obtained in the second case (0.0019 mD) is close to the actual model parameter (0.001 mD). FIG. 13 provides estimated true reservoir pressure by using conventional analysis and supercharge model respectively. In this example, the supercharge model is applied to the extended shut-in section of the automated pulse test to optimize reservoir pressure determination. Having the permeability calculated in FIG. 13, the true initial pressure can be determined from Equation (14) directly in FIG. 14. In comparison, the conventional analysis using the interception of the tangential line of the early section data with pressure axis results in an inaccurate report on the initial reservoir pressure. Note that in this example, the true initial reservoir pressure is 20,000 psi with 1,000 psi overbalance, and the prediction using supercharge model and conventional analysis is 20,003 psi and 20,375 psi respectively, which demonstrates the importance of integration of automated pulse test with supercharge model.

It should also be noted that in this analysis, the observation probe data obtained outside the packer wall was not used to calculate the reservoir properties, but it can be used to infer more information of the reservoir, and obtain more reservoir properties such as vertical $k_v$ and horizontal $k_h$ permeability and anisotropy $k_v/k_h$. It can also be used by the next method to accurately match the features.

Figure 15:
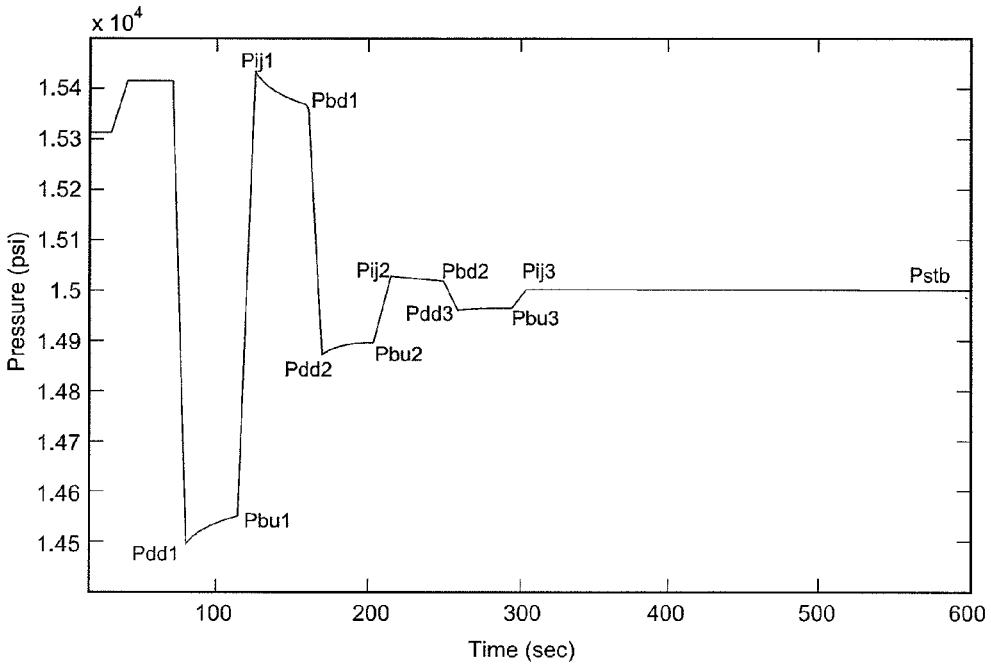
FIG. 15 is a chart depicting feature pressures of a pulse test, in accordance with certain embodiments of the present disclosure.

The pulse feature matching technique of the present disclosure may be considered as an inverse process of pulse design optimization and also implemented with genetic algorithm. In pulse test design, several operational parameters may be optimized for the given reservoir parameters and tool configuration. In pulse feature matching, the tool configuration and pulse test parameters are fixed, and several important formation parameters, such as formation pressure and porosity, fluid mobility (the ratio of reservoir permeability and fluid viscosity) and compressibility may be evolved through GA to minimize the pressure difference at the selected feature points. The feature points are basically the pressure switching points recorded during the field pulse test, as shown in FIG. 15. Pdd1 is the pressure at the end of the first drawdown, Pbu1 is the pressure at the first buildup, Pij1 is the pressure at the first injection, Pbd1 is the pressure at the first builddown, Pdd2 is the pressure at the second drawdown; Pbu2 is the pressure at the second buildup, Pij2 is the pressure at the second injection; Pbd2 is the pressure at the second builddown, Pdd3 is the pressure at the third drawdown, Pbu3 is the pressure at the third buildup, Pij3 is the pressure at the third injection, and Pstb is the pressure at the reference stabilization point.

Figure 16:
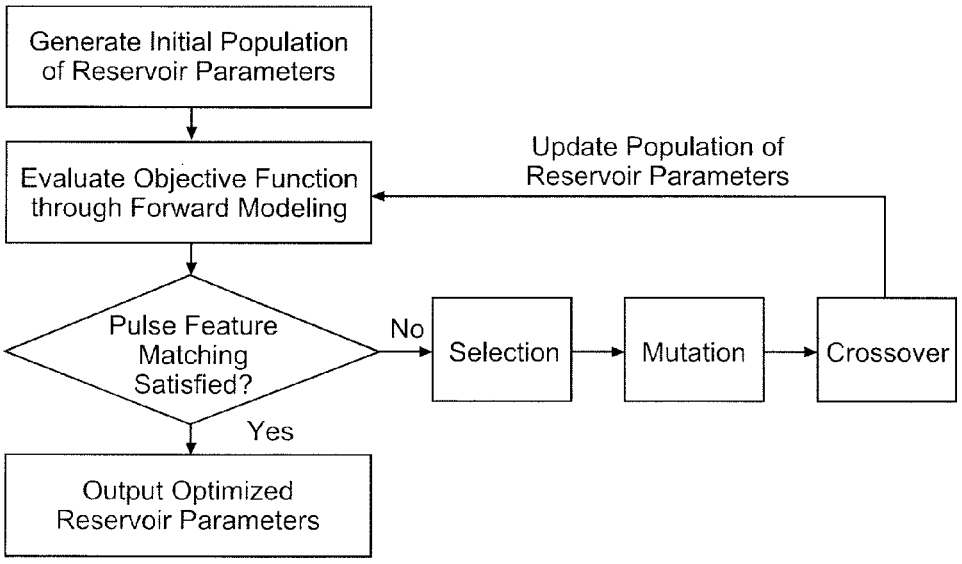
FIG. 16 is a flow chart of an algorithm for determining reservoir parameters, in accordance with certain embodiments of the present disclosure.
Figure 17:
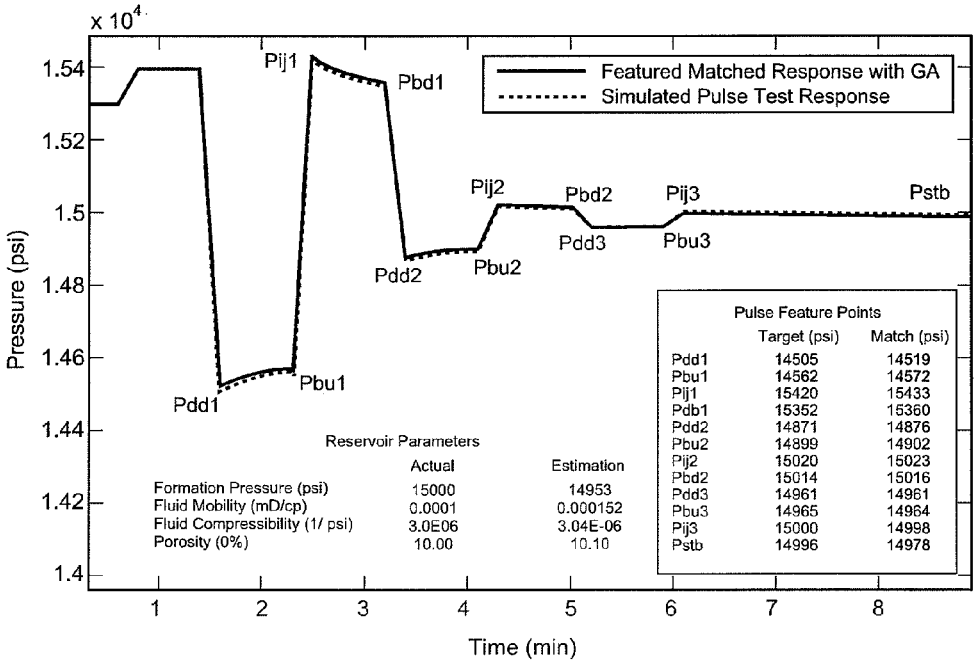
FIGS. 17 and 18 are charts comparing re-constructed and simulated reservoir parameters, in accordance with certain embodiments of the present disclosure.
Figure 18:
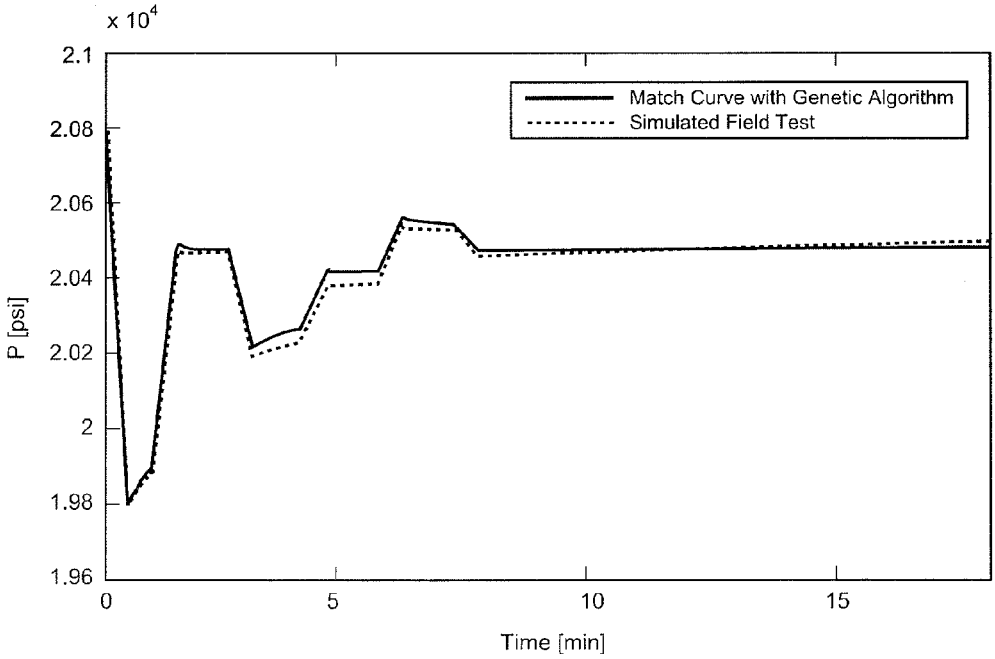

Multiple reservoir parameters may be estimated through pulse feature matching. FIG. 16 illustrates a flow chart of an algorithm for determining reservoir parameters from pulse feature matching with the use of forward analytic/numerical models and genetic algorithms. Considering an example with four unknown reservoir parameters (formation pressure, fluid mobility and compressibility, reservoir porosity), the dynamic data range of each parameter for GA searching can be pre-determined based on the prior knowledge of parameter uncertainty. The simulation results using the analytical and the numerical models are summarized in FIGS. 17 and 18. FIG. 18 shows a comparison of reconstructed and actual (simulated) reservoir parameters through pulse test with the analytical model. FIG. 22 shows a comparison of the reconstructed match and actual synthetic reservoir model through the automated pulse test method with the numerical method.

Figure 19:
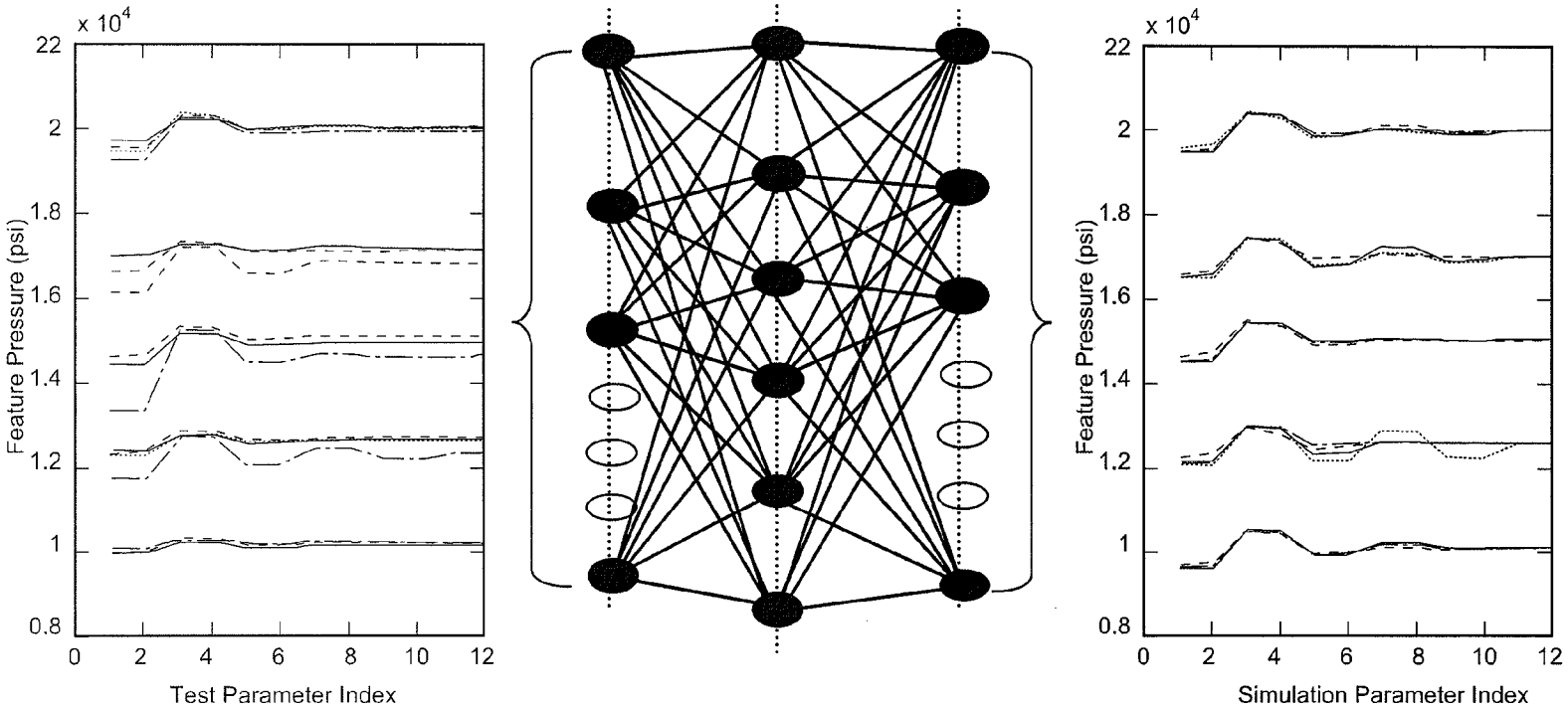
FIG. 19 is an illustration of a method to perform calibration transfer using a neural network.

Generally for pulse-test data inversion, the numerical method could simulate the field experiments more closely by including considerably detailed geometrics and additional boundary conditions, but it is limited with high-intensity computation in standard practice compared to using analytical model based inversion. This shortcoming could be overcome through a robust mapping, which compensates all borehole environmental factors and generates analytically equivalent measurements that can be processed with a faster inversion algorithm. In one embodiment, a pulse testing data transformation algorithm is implemented with a neural network (NN) using feature pressure points simulated with numerical and analytical methods as inputs and outputs for model development. FIG. 19 conceptually shows the NN transformation algorithm to convert feature pressure points (12 points in this example) of numerical simulations, which are close analogue for field test, to the same number of feature points obtained from analytical simulations. Note that the supercharge effect observed in numerical simulations is compensated through transformation, which allows fast inversion under analytically near-ideal conditions. In this application, the pulse parameters are optimized first on the selected examples, and set to the same for each transformation pair of numerical and analytical simulations. Moreover, the pulse sequence requires a fixed pattern, i.e., same number of drawdown, shut-in and injection tests in order, applied to field tests.

In certain embodiments, the methods discussed herein may use a sequence of drawdown/injection pulse to minimize stabilization time of pretest. These methods may use a pulse testing sequence to minimize the time required to determine formation properties such as formation pressure, supercharge pressure (under or overbalance), formation mobility, formation permeability mud properties and formation skin or damage from test sequence. In certain embodiments, at least one additional monitoring probe that is offset in the vertical or horizontal direction may also be used to determine formation properties and for testing optimization. The methods discussed herein may integrate design optimization, test automation, derivative plot, feature matching and calibration transfer into a single system. The methods discussed herein may incorporate analytical and numerical simulations with computation intelligence techniques and field data analysis. The methods disused herein may use any method of pressure feedback and control system to reach the pressure stabilization or formation property determination.

In certain embodiments, forward analytical and numerical flow models may be used to simulate a pulse test given the reservoir parameters, pulse parameters, and tool configuration. For example, in analytical simulations, the system pressure response at the current time/pulse may be superposed with previous pulses. In certain embodiments, the pulse testing simulations may include borehole storage and skin factors for Darcy flow. The pulse testing simulation may also include anisotropic effect and non-Darcy flow such as slippage, transition flow, and diffusion.

In certain embodiments, a genetic algorithm with forward model for inverse analysis may be used to determine the reservoir parameters. In certain embodiments, an analytical data transformation algorithm may be used in conjunction with the inverse analysis.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are each defined herein to mean one or more than one of the element that it introduces.

What is claimed is:

1. A method of determining a reservoir parameter of a subterranean formation comprising:

initiating an initial pressure pulse in the subterranean formation, wherein the initial pressure pulse comprises an initial drawdown pulse, an initial buildup time, an initial injection pulse and an initial buildown time;

determining an initial drawdown pressure by subtracting from an initial reservoir pressure a product of a pressure conversion factor and a first dimensionless pressure response, wherein the first dimensionless pressure response is a first flow model determined by a drawdown test duration, a source radius, a borehole storage coefficient and a skin factor;

determining an initial buildup pressure by adding the initial drawdown pressure to a product of the pressure conversion factor and a second dimensionless pressure response, wherein the second dimensionless pressure response is a second flow model determined by a build up test duration, the source radius, the borehole storage coefficient and the skin factor;

determining an initial injection pressure by adding to the initial buildup pressure a product of the pressure conversion factor and a third dimensionless pressure response, wherein the third dimensionless pressure response is a third flow model determined by an injection test duration, the source radius, the borehole storage coefficient and the skin factor;

determining a builddown pressure by subtracting from the initial injection pressure a product of the pressure conversion factor and a fourth dimensionless pressure response, wherein the fourth dimensionless pressure response is a fourth flow model determined by a builddown test duration, the source radius, the borehole storage coefficient and the skin factor;

initiating a first series of subsequent pressure pulses in the subterranean formation, wherein the first series of subsequent pressure pulses comprises at least a first drawdown pulse, a first buildup time, a first injection pulse and a first buildown time, wherein each of the first series of subsequent pressure pulses is optimized utilizing an analytical simulation model, and wherein the analytical simulation model comprises a system pressure response at a time per pressure pulse superposed with one or more previous pressure pulses;

record a shut-in pressure during a no flow period;

initiating a second series of pressure pulses in the subterranean formation based on the shut-in pressure, wherein the second series of pressure pulses comprises at least a second drawdown pulse, a second buildup time, a second injection pulse and a second buildown time, wherein each of the second series of pressure pulses is optimized utilizing the analytical simulation model; and determining the reservoir parameter.

2. The method of claim 1, wherein each subsequent pressure pulse is optimized utilizing a genetic evolutionary optimization method.

3. The method of claim 1, wherein the reservoir parameter comprises at least one reservoir parameter selected from the group consisting of stabilized pressure, actual formation pressure, formation mobility, fluid compressibility, a mudcake property and formation damage.

4. The method of claim 1, wherein each pressure pulse is followed by a stabilization period.

5. The method of claim 4, further comprising measuring the pressure of the subterranean formation during the stabilization period.

6. The method of claim 5, wherein the measured pressure of the subterranean formation during the stabilization period is used to determine the subsequent pressure pulse.

7. The method of claim 6, wherein each subsequent pressure pulse moves the measured pressure of the subterranean formation during the stabilization period closer to a stabilized pressure than the previous pressure pulse.

8. The method of claim 1, wherein the initial pressure pulse continues to be generated until a desired pressure, pressure transient, or volume is obtained.

9. The method of claim 1, wherein the initial pressure pulse is varied until a desired pressure is obtained.

10. A method of determining a reservoir parameter of a subterranean formation comprising:

initiating an initial pressure pulse in the subterranean formation, wherein the initial pressure pulse comprises an initial drawdown pulse, an initial buildup time, an initial injection pulse and an initial buildown time;

determining an initial drawdown pressure by subtracting from an initial reservoir pressure a product of a pressure conversion factor and a first dimensionless pressure response, wherein the first dimensionless pressure response is a first flow model determined by a drawdown test duration, a source radius, a borehole storage coefficient and a skin factor;

determining an initial buildup pressure by adding the initial drawdown pressure to a product of the pressure conversion factor and a second dimensionless pressure response, wherein the second dimensionless pressure response is a second flow model determined by a build up test duration, the source radius, the borehole storage coefficient and the skin factor;

determining an initial injection pressure by adding to the initial buildup pressure a product of the pressure conversion factor and a third dimensionless pressure response, wherein the third dimensionless pressure response is a third flow model determined by an injection test duration, the source radius, the borehole storage coefficient and the skin factor;

determining a builddown pressure by subtracting from the initial injection pressure a product of the pressure conversion factor and a fourth dimensionless pressure response, wherein the fourth dimensionless pressure response is a fourth flow model determined by a builddown test duration, the source radius, the borehole storage coefficient and the skin factor;

initiating a first series of pressure pulses in the subterranean formation, wherein the first series of pressure pulses comprises at least a first drawdown pulse, a first buildup time, a first injection pulse and a first buildown time, wherein the first drawdown pulse time and the first buildup time of each of the first series of pressure pulses is optimized utilizing an analytical simulation model, and wherein the analytical simulation model comprises a system pressure response at a time per pressure pulse superposed with one or more previous pressure pulses;

record a shut-in pressure during a no flow period;

initiating a second series of pressure pulses in the subterranean formation based on the shut-in pressure, wherein the second series of pressure pulses comprises at least a second drawdown pulse, a second buildup time, a second injection pulse and a second buildown time, wherein each of the second series of pressure pulses is optimized utilizing the analytical simulation model; and determining the reservoir parameter.

11. The method of claim 10, wherein the drawdown pulse time and the buildup time of each subsequent pressure pulse is optimized utilizing a genetic evolutionary optimization method.

12. The method of claim 10, wherein a drawdown pulse time of each subsequent pressure pulse is in the range of from 10 seconds to 120 seconds.

13. The method of claim 10, wherein the subsequent buildup time of each subsequent pressure pulse is in the range of from 30 seconds to 120.

14. The method of claim 10, wherein the initial pressure pulse and the subsequent pressure pulses are initiated using a straddle-packer formation tester, a standard probe, or an oval probe.

15. A method of determining a reservoir parameter of a subterranean formation with an initial pressure comprising:

(a) initiating an initial pressure pulse in the subterranean formation followed by a no flow period, wherein the pressure pulse comprises an initial drawdown pulse, an initial buildup time, an initial injection pulse and an initial buildown time;

(b) determining an initial drawdown pressure by subtracting from an initial reservoir pressure a product of a pressure conversion factor and a first dimensionless pressure response, wherein the first dimensionless pressure response is a first flow model determined by a drawdown test duration, a source radius, a borehole storage coefficient and a skin factor;

(c) determining an initial buildup pressure by adding the initial drawdown pressure to a product of the pressure conversion factor and a second dimensionless pressure response, wherein the second dimensionless pressure response is a second flow model determined by a build up test duration, the source radius, the borehole storage coefficient and the skin factor;

(d) determining an initial injection pressure by adding to the initial buildup pressure a product of the pressure conversion factor and a third dimensionless pressure response, wherein the third dimensionless pressure response is a third flow model determined by an injection test duration, the source radius, the borehole storage coefficient and the skin factor;

(e) determining a builddown pressure by subtracting from the initial injection pressure a product of the pressure conversion factor and a fourth dimensionless pressure response, wherein the fourth dimensionless pressure response is a fourth flow model determined by a builddown test duration, the source radius, the borehole storage coefficient and the skin factor;

(f) initiating a first pressure pulse in the subterranean formation, wherein the first pressure pulse comprises at least a first drawdown pulse, a first buildup time, a first injection pulse and a first buildown time, wherein the first pressure pulse is optimized utilizing an analytical simulation model, and wherein the analytical simulation model comprises a system pressure response at a time per pressure pulse superposed with one or more previous pressure pulses;

(g) measuring a shut-in pressure of the subterranean formation during a no flow period;

(h) initiating a second pressure pulse in the subterranean formation based on the shut-in pressure, wherein the second pressure pulse comprises at least a second drawdown pulse, a second buildup time, a second injection pulse and a second buildown time wherein the second pressure pulse is optimized utilizing the analytical simulation model;

(i) repeating steps (g)-(h) until a number of iterations exceeds a pre-determined threshold; and (j) determining the reservoir parameter.

16. The method of claim 15, wherein the second pressure pulse of step (h) is optimized by optimizing a drawdown pulse time and the subsequent buildup time of the subsequent pressure pulse.

17. The method of claim 15, wherein the reservoir parameter comprises at least one reservoir parameter selected from the group consisting of stabilized pressure, actual formation pressure, formation mobility, formation permeability, a mudcake property and formation damage.

18. The method of claim 15, wherein the pressure pulse in step (a) is initiated using a straddle-packer formation tester, a standard probe, or an oval probe.

* * * * *